US006361741B1

(12) United States Patent
Klemp et al.

(10) Patent No.: US 6,361,741 B1
(45) Date of Patent: Mar. 26, 2002

(54) BRAZEABLE 6XXX ALLOY WITH B-RATED OR BETTER MACHINABILITY

(75) Inventors: Thomas J. Klemp, Massena, NY (US); Richard A. Jeniski, Jr., New Kensington; David W. Hohman, Hamburg, both of PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/495,137

(22) Filed: Jan. 31, 2000

Related U.S. Application Data

(60) Provisional application No. 60/118,040, filed on Feb. 1, 1999.

(51) Int. Cl.[7] ..... C22C 21/08
(52) U.S. Cl. ..... 420/535; 420/544; 420/546
(58) Field of Search ..... 420/530, 535, 420/534, 544, 546

(56) References Cited

U.S. PATENT DOCUMENTS

| | | | | |
|---|---|---|---|---|
| 2,096,010 A | | 10/1937 | Sicha | 75/147 |
| 4,040,822 A | | 8/1977 | Stern | 75/140 |
| 4,589,932 A | | 5/1986 | Park | 148/12.7 A |
| 5,282,909 A | * | 2/1994 | Ara et al. | 148/439 |
| 5,286,445 A | | 2/1994 | Kamiya | 420/530 |
| 5,375,760 A | | 12/1994 | Doko | 228/183 |
| 5,520,321 A | | 5/1996 | Childree | 228/183 |
| 5,522,950 A | | 6/1996 | Bartges et al. | 148/550 |
| 5,535,939 A | | 7/1996 | Childree | 228/252 |
| 5,564,619 A | | 10/1996 | Childree | 228/252 |
| 5,587,029 A | | 12/1996 | Sircar | 148/438 |

FOREIGN PATENT DOCUMENTS

| | | | |
|---|---|---|---|
| JP | 53-033909 | * | 7/1985 |
| JP | 60-138039 | * | 7/1985 |

* cited by examiner

*Primary Examiner*—George Wyszomierski
*Assistant Examiner*—Janelle Combs-Morillo
(74) *Attorney, Agent, or Firm*—Gary P. Topolosky

(57) ABSTRACT

This invention relates to an aluminum alloy with B-rated or better machineability, said alloy being suitable for using as brazing in the Nocolock® process. The alloy consists essentially of: about 0.5–0.8 wt. % silicon; about 0.4–0.6 wt. % magnesium; about 0.4–0.72 wt. % tin; up to about 0.5 wt. % iron; up to about 0.3 wt. % copper; up to about 0.35 wt. % manganese; up to about 0.15 wt. % chromium; and up to about 0.2 wt. % zinc; the balance aluminum and incidental elements and impurities. This product is preferentially processed into one or more of the following tempers: T1, T5, T6, T651, T6510, T6511, T8, T851, and T9.

17 Claims, No Drawings

BRAZEABLE 6XXX ALLOY WITH B-RATED OR BETTER MACHINABILITY

CROSS REFERENCE TO RELATED APPLICATIONS

This application claims the benefit of U.S. Provisional Application Ser. No. 60/118,040, filed on Feb. 1, 1999, the disclosure of which is fully incorporated by reference herein.

FIELD OF THE INVENTION

This invention relates to 6000 series aluminum alloys. More particularly, it relates to 6XXX alloys that are brazeable per a process that employs Nocolok® brand fluxes (sometimes referred to as the "Nocolok brazing process"). Nocolok is a registered trademark of Alcan Aluminium Ltd of Canada. Typical 6000 Series or 6XXX brazing alloys include 6063 and 6005 aluminum (Aluminum Association designations). While said alloys may be brazed via the Nocolok process, they generally exhibit poor machinability (C or D ratings). The reason for their brazing success lies in the fact that their Mg contents lie well below 0.5 wt. %. 6XXX alloys with greater than 0.5 weight percent Mg, such as 6061 aluminum, don't perform as well in Nocolok brazing operations. It is believed their higher Mg levels tend to poison the brazing flux by the formation of Mg—F compounds (like $MgF_2$).

BACKGROUND OF THE INVENTION

Numerous brazeable aluminum alloys have been patent protected. Representative compositions include those taught by U.S. Pat. Nos. 4,040,822, 5,375,760, 5,520,321, 5,535,939, and 5,564,619. Still other aluminum alloys, not specific to brazing, with Nocolok or otherwise, are taught in U.S Pat. Nos. 2,096,010, 4,589,932, 5,286,445, 5,522,950 and 5,587,029.

SUMMARY OF THE INVENTION

A 6XXX alloy that is Nocolok® brazeable and has B-rated machineability or better was created using a base composition with slightly less than 0.5 wt. % Mg, but excess Si for strengthening. Tin (Sn) was added thereto to enhance the overall machineability of products made from this alloy. Sn has a relatively low melting point. But when Sn is present in large amounts, the alloy may flow unacceptably during brazing. A primary objective of this invention is to create a Nocolok® brazeable 6XXX alloy that balances Sn levels to be just high enough for B-machinability or better without causing the aforesaid flow problems. Another primary objective is to add sufficient amounts of magnesium to this alloy for strength, but still maintain good brazeability.

DETAILED DESCRIPTION OF PREFERRED EMBODIMENTS

All component percentages herein are by weight percent unless otherwise indicated. Also, when referring to any numerical range of values, such ranges are understood to include each and every number and/or fraction between the stated range mininum and maximum. A range of about 0.5 to 1.2 wt % silicon, for example, would expressly include all intermediate values of about 0.6, 0.7 and 0.8% Si, all the way up to and including 1.1 and 1.19% Si. The same applies to each other numerical property and/or elemental range set forth herein.

In a broad sense, the brazeable aluminum alloy of this invention comprises an alloy consisting essentially of about 0.5–1.2 wt. % Si; up to about 0.5 wt. % Fe; up to about 0.3 wt. % Cu; between about 0.4–0.6 wt. % Mg; up to about 0.35 wt. % Mn; up to about 0.15 wt. % Cr; between about 0.4–0.8 wt. % Sn; up to about 0.2 wt. % Zn, the balance aluminum, incidental elements and impurities. On a less preferred basis, Bi, In, Cd or combinations thereof, may be substituted for some of the Sn therein. And while preferred embodiments of this invention are best suited for brazing-type applications, it is to be understood that the same alloy may have suitable non-brazing end uses as well.

On a more preferred basis, the alloy composition of this invention consists essentially of: about 0.6–0.8 wt. % silicon; about 0.2–0.4 wt. % iron; about 0.05–0.15 wt. % copper; about 0.4–0.5 wt. % magnesium; up to about 0.35 wt. % Mn; up to about 0.15 wt. % chromium; between about 0.5–0.6 wt. % tin; up to about 0.1 wt. % titanium; up to about 0.20 wt. % zinc, the balance aluminum, incidental elements and impurities. This product is preferentially processed into one or more of the following tempers: T1, T5, T6, T651, T6510, T6511, T8, T851, and T9.

EXAMPLES

For comparative purposes, a series of wrought alloys were cast as set forth in following table, then extruded into rod:

TABLE 1

| | Chemical Composition (wt. %) | | | | | | |
|---|---|---|---|---|---|---|---|
| Sample | Si | Fe | Cu | Mn | Mg | Cr | Sn |
| A | 0.69 | 0.37 | 0.00 | 0.02 | 0.45 | 0.06 | 0.00 |
| B | 0.69 | 0.36 | 0.00 | 0.02 | 0.44 | 0.06 | 0.28 |
| C | 0.69 | 0.35 | 0.00 | 0.02 | 0.45 | 0.07 | 0.55 |
| D | 0.69 | 0.36 | 0.00 | 0.02 | 0.47 | 0.06 | 0.75 |
| E | 0.70 | 0.36 | 0.16 | 0.02 | 0.46 | 0.06 | 0.56 |
| F | 0.70 | 0.36 | 0.28 | 0.02 | 0.47 | 0.06 | 0.56 |

Specimens from each alloy, after tempering to a T6 condition, were cut and subjected to both strength and % elongation tests. The results of those tests are summarized in Table 2 below, all measured in the Longitudinal direction.

TABLE 2

| Sample ID | Machinability Rating | Yield Strength (ksi) | Tensile Strength (ksi) | Elongation % |
|---|---|---|---|---|
| A-1 | C⁻ | 34.3 | 36.6 | 15.6 |
| A-2 | C⁻ | 34.6 | 36.9 | 14.8 |
| B-1 | C | 33.6 | 37.7 | 10.9 |
| B-2 | C | 33.0 | 38.2 | 11.7 |
| C-1 | B | 34.5 | 39.1 | 10.9 |
| C-2 | B | 33.0 | 37.2 | 9.4 |
| D-1 | C | 32.4 | 37.0 | 12.5 |
| D-2 | C | 32.2 | 36.8 | 12.5 |
| E-1 | C | 31.6 | 37.3 | 15.6 |
| E-2 | C | 32.7 | 37.8 | 14.1 |
| F-1 | C | 35.0 | 40.9 | 18.8 |
| F-2 | C | 34.9 | 40.9 | 17.2 |

Still other examples of this invention, consistent with alloy composition C above, were heat treated per known T8 and T9 tempering practices. These Table 1, Alloy C specimens achieved "B rated" machineability values and the following mechanical property average values:

TABLE 3

| Average Mechanical Properties-Longitudinal Direction | T8 Tempered | T9 Tempered |
|---|---|---|
| Tensile Strength (ksi) | 37 | 46 |
| Yield Strength (ksi) | 35 | 45 |
| % Elongation | 16 | 10 |

The foregoing T8 and T9 extruded rod sections of the invention alloy were subjected to 30 day Stress Corrosion Cracking tests. For each test, the specimens, either 0.75" C-rings or 0.125" threaded end tensile bars, were exposed to 3.5% NaCl by alternate immersion per ASTM Testing Standard G44 (the disclosure of which is fully incorporated by reference herein). The T8 temper specimens were subjected to 26 ksi stress levels and the T9 to the higher level of 31 ksi for the 30 day trial period. The specimens were checked ahnost daily for SCC cracking, but after 30 days, no cracks were observed for either temper . . . in either product form.

In another corrosion test, pursuant to ASTM Standard B117 (the disclosure of which is also fully incorporated by reference herein), both test specimens of the invention alloy, tempered according to T8 and T9 practices, showed good general corrosion resistance when exposed to about 1000 hours of continuous spraying of a 5% NaCl solution at 95° F. After such tests, these specimens appeared to have only staining with no signs of pitting.

Having described the presently preferred embodiments, it is to be understood that the invention may be otherwise embodied within the scope of the claims below.

What is claimed is:

1. An aluminum alloy with B-rated or better machineability, said alloy consisting essentially of: about 0.5–0.8 wt. % silicon; about 0.4–0.55 wt. % magnesium; about 0.4–0.72 wt. % tin; about 0.21–0.4 wt. % iron; up to about 0.3 wt. % copper; up to about 0.35 wt. % manganese; up to about 0.15 wt. % chromium; up to about 0.2 wt. % zinc; and at least some titanium for grain refinement purposes, the balance aluminum and incidental elements and impurities.

2. The aluminum alloy of claim 1 which contains about 0.5–0.6 wt. % tin.

3. The aluminum alloy of claim 1 which contains about 0.6–0.75 wt. % silicon.

4. The aluminum alloy of claim 1 which contains about 0.05–0.15 wt. % copper.

5. The aluminum alloy of claim 1 which contains about 0.4–0.5 wt. % magnesium.

6. An aluminum-based alloy with improved machining and corrosion resistance properties, said alloy being suitable for use as brazing and consisting essentially of: about 0.5–0.8 wt. % silicon; about 0.4–0.55 wt. % magnesium; about 0.4–0.72 wt. % tin; about 0.21–0.4 wt. % iron; up to about 0.3 wt. % copper; up to about 0.35 wt. % manganese; up to about 0.15 wt. % chromium; up to about 0.2 wt. % zinc; and at least some titanium for grain refinement purposes, the balance aluminum and incidental elements and impurities.

7. The aluminum alloy of claim 6 which contains about 0.5–0.6 wt. % tin.

8. The aluminum alloy of claim 6 which contains about 0.6–0.75 wt. % silicon.

9. The aluminum alloy of claim 6 which contains about 0.05–0.15 wt. % copper.

10. The aluminum alloy of claim 6 which contains about 0.4–0.5 wt. % magnesium.

11. The aluminum alloy of claim 6 which has been thermally processed to a temper selected from the group consisting of T1, T5, T6, T651, T6510, T6511, T8, T851, and T9.

12. An aluminum-based alloy with B-rated or better machineability, said alloy being suitable for use as brazing and consisting essentially of: about 0.5–0.8 wt. % silicon; about 0.4–0.55 wt. % magnesium; about 0.4–0.72 wt. % tin; about 0.21–0.4 wt. % iron; up to about 0.3 wt. % copper; up to about 0.35 wt. % manganese; up to about 0.15 wt. % chromium; up to about 0.2 wt. % zinc; and at least some titanium for grain refinement purposes, the balance aluminum and incidental elements and impurities.

13. The aluminum alloy of claim 12 which contains about 0.5–0.6 wt. % tin.

14. The aluminum alloy of claim 12 which contains about 0.6–0.75 wt. % silicon.

15. The aluminum alloy of claim 12 which contains about 0.05–0.15 wt. % copper.

16. The aluminum alloy of claim 12 which contains about 0.4–0.5 wt. % magnesium.

17. The aluminum alloy of claim 12 which has been thermally processed to a temper selected from the group consisting of T1, T5, T6, T651, T6510, T6511, T8, T851, and T9.

* * * * *